US005322014A

United States Patent [19]

Keller

[11] Patent Number: 5,322,014

[45] Date of Patent: Jun. 21, 1994

[54] PRINTING PLATE REGISTER SYSTEM, DEVICE, AND METHOD

[76] Inventor: James J. Keller, 4023 Glenridge Rd., Dallas, Tex. 75220

[21] Appl. No.: 934,950

[22] Filed: Aug. 25, 1992

[51] Int. Cl.[5] ..... B41F 27/12

[52] U.S. Cl. ..... 101/415.1; 101/DIG. 36

[58] Field of Search ..... 101/378, 382.1, 383, 101/415.1, 477, 481, 485, 486, DIG. 36; 33/614, 615, 617-621, 623

[56] References Cited

U.S. PATENT DOCUMENTS

| | | | |
|---|---|---|---|
| 3,406,626 | 10/1968 | Ternes | 101/211 |
| 3,572,228 | 3/1971 | Ternes | 95/11 |
| 3,634,009 | 1/1972 | Van Dusen et al. | 101/DIG. 36 |
| 3,828,672 | 8/1974 | Gazzola et al. | 101/415.1 |
| 3,957,371 | 5/1976 | Rich | 101/128.1 |
| 4,244,109 | 1/1981 | Silverman | 33/645 |
| 4,359,941 | 11/1982 | Fels | 101/415.1 |
| 4,529,303 | 7/1985 | Ternes | 355/91 |
| 4,563,085 | 1/1986 | Ternes | 355/132 |
| 4,605,298 | 8/1986 | Russel et al. | 101/217 |
| 4,688,484 | 8/1987 | Herold et al. | 101/378 |
| 4,809,609 | 3/1989 | Sugiura et al. | 101/415.1 |
| 4,977,683 | 12/1990 | Harder | 33/621 |
| 4,977,833 | 12/1990 | Inage et al. | 101/415.1 |

FOREIGN PATENT DOCUMENTS

| | | | |
|---|---|---|---|
| 120059 | 6/1985 | Japan | 101/415.1 |
| 2054467 | 2/1981 | United Kingdom | 101/415.1 |

*Primary Examiner*—Edgar S. Burr
*Assistant Examiner*—Stephen R. Funk
*Attorney, Agent, or Firm*—John W. Montgomery

[57] ABSTRACT

A printing plate registration device, system, and method of the type for replaceably holding a printing plate in proper registration on a plate cylinder for use in an offset printing pres. The registration device includes tapered registration pins affixed to the plate cylinder in registration alignment. The tapered pins have a base which is sized for interference fit with registration holes formed in the replaceable printing plate. A clamp is attached for replaceably holding the printing plate into rigid interference fit around the base of each of the tapered registration pins.

15 Claims, 4 Drawing Sheets

PRINTING PLATE REGISTER SYSTEM, DEVICE, AND METHOD

TECHNICAL FIELD OF THE INVENTION

The present invention relates to a printing plate registration system, and in particular, to a system and device for using tapered pins to accurately locate or register replaceable printing plates on plate cylinders of an offset printing press.

BACKGROUND OF THE INVENTION

Previously known offset printing presses have generally used a printing plate registration system comprising a series of hardened, aligned pins adjustably positionable across the face of the printing plate cylinder with correspondingly positioned registration holes punched along one edge of a thin sheet metal printing plate. The pins are inserted through the larger registration holes as the printing plate with an image chemically formed thereon is placed circumferentially around the plate cylinder. An operator manually holds the printing plate so that the leading edges of the registration holes are firmly against the leading arc of the smaller pins. Thus held, the printing plate is clamped along its leading edge to hold it rigidly in place. The trailing edge of the printing plate is gripped with similar pins inserted through similarly punched tension holes along the trailing edge of the printing plate. Tension is placed on the printing plate by drawing the printing plate circumferentially around the plate cylinder. Typically, the trailing edge tension pins merely apply a sufficient even tension on the printing plate to hold it around the cylinder without changing its orientation with respect to the clamped leading edge. The position of the leading edge registration pins can be adjusted using knurled knob screws on either end of a bar holding the leading register pins. Once the printing plate is properly aligned, so that the image is parallel to the axis of rotation of the printing roller and also so that the image is properly spaced circumferentially around the plate, then printing can be initiated.

In the case of multiple roller offset printing presses, such as multi-color printing, each printing plate which applies dots of color must be adjusted for coordinated registration with each other printing plate, which applies dots of another color so that the color dots are properly aligned for application to the printing material to produce a sharp, rather than a blurred image. The registration holes are larger than the pins by which they are engaged, so that the operator can easily place the printing plates thereover. This, however, permits the operator to inadvertently hold each of the separate printing plates at a slightly different orientation prior to clamping. It becomes necessary to realign the plates at each roller for each printing job. Misalignment by a few thousandths of an inch at the registration pins can result in a blurred image or an otherwise poor quality printing job.

SUMMARY OF THE INVENTION

These and other disadvantages are overcome in the present invention with the use of a system by which the registration holes are consistently punched in the printing plates for each of the separate color image imprints. The holes are punched prior to the time the image is photo-chemically formed on the printing plate in precise proper alignment and are precisely and uniformly sized for fitting onto uniformly sized tapered registration pins. The tapered registration pins are rigidly held on a support bar which can be positioned with respect to each plate cylinder one time and then locked into place. The printing plates may be easily placed onto the tapered pins which have small tops and larger base portions the same shape as the holes. The holes are smaller than the base portions of the pins. A clamp jaw, having holes therein corresponding to the shape of the tapered pins, clamps the printing plates onto the tapered pins with a small amount of deformation entirely around the punched holes. Lifting arms are positioned adjacent each registration pin in an undercut channel so that they are out of the way when the printing plate is placed on the tapered registration pins and clamped into position. The lifting arms are activatable for removing the plate by lifting the printing plate up with sufficient force to disengage the printing plate from the tapered pins.

Thus, wedging of the plates onto the tapered pin provides sufficient omni-directional support entirely around each pre-punched registration hole of the printing plate so that it is rigidly held in proper alignment despite minor tilting or sliding pressure asserted by the operator when installing the plate. A one time adjustment of the registration device at each plate cylinder is all that is required before the press can be repeatedly used for subsequent printing jobs without readjusting the position of the registration pins for each separate job, as is currently a normal practice.

BRIEF DESCRIPTION OF THE DRAWINGS

These and other objects and advantages of the invention will be more fully understood with reference to the following detailed description, claims and drawings, in which like numerals represent like elements and in which:

DETAILED DESCRIPTION OF THE PREFERRED EMBODIMENTS

Figure 1:
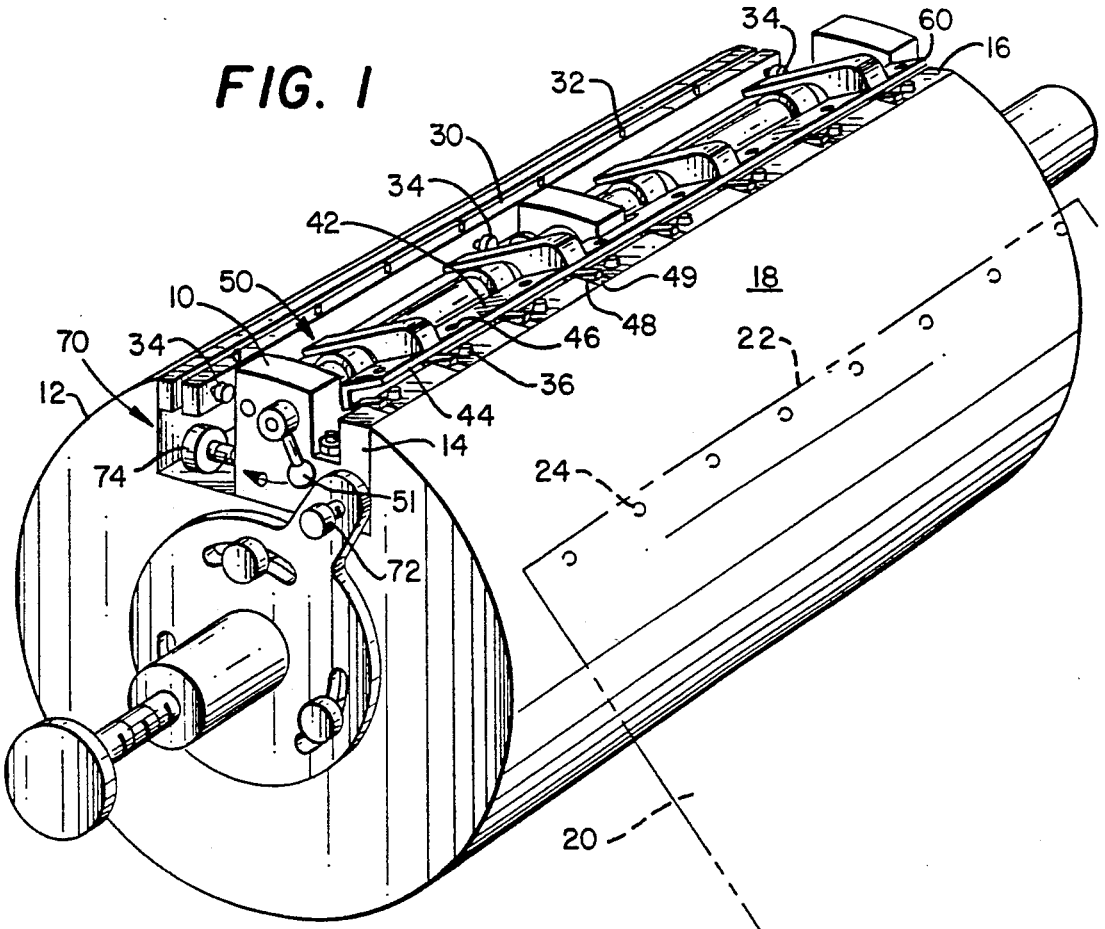
FIG. 1 is a perspective schematic view of a printing press plate cylinder having the inventive tapered pin registration device positioned thereon.

FIG. 1 shows a perspective schematic view of a preferred embodiment of a tapered pin registration device 10 mounted in a printing press plate cylinder 12. The tapered pin registration device 10 includes support bar 14 which presents a printing plate support surface 16 which is aligned parallel to cylindrical surface 18 of the plate cylinder 12. Tapered pins 36 are affixed to support surface 16 projecting a short distance thereabove.

Shown in phantom lines is a printing plate 20 which is typically formed of a thin metallic plate having an image chemically formed thereon. The image may be a portion of a total image, such as one color of a multiple color picture. Typically, the plate is made receptive to ink holding areas or dots of ink, and alternatively interposed wetting agent, which ink and wetting agent are applied to form a particular color image. The printing plate 20 has a leading edge 22 into which uniformly sized registration holes 24 are formed, preferably by punching. The holes 24 are typically circular holes for ease and consistency of manufacture and such circular holes are advantageously used in the preferred embodiment of the present invention. Other hole shapes may be punched or otherwise formed without departing from certain aspects of the present invention, as will be understood more fully below. The trailing edge 26 of printing plate 20 has tension holes 28 punched or otherwise formed therein.

The registration holes 24 and the leading edge 22 is clamped into engagement on the tapered pins 36 and between a clamping surface 44 and support surface 16 of registration device 10, as will be explained more fully below. Plate 20 is wrapped around the cylindrical surface 18 and tension is placed thereon with a trailing edge tensioning device 30. The tensioning device 30 may be a standard trailing edge tensioning device which is shown schematically as one with tension pins 32 which are sized for engagement into trailing edge tension holes 28. An appropriate amount of tension is applied as through adjusting screws 34 on tensioning device 30, or through known tension mechanisms, so that the printing plate 20 is in surface-to-surface contact with cylindrical surface 18 of plate cylinder 12.

In order to insure proper positioning and orientation, i.e., proper registration of printing plate 20, tapered registration pins 36 are rigidly affixed to the tapered pin registration device 10. In the preferred embodiment, a plurality of truncated conical-shaped pins 36 are rigidly affixed along support bar 14 projecting perpendicularly upwardly from support surface 16. In one preferred embodiment, hardened steel pins are pressed into precisely drilled holes in support surface 16. The number of pins is not normally critical, although at least two conically shaped pins (i.e., tapered pins with circular cross-sections) are required in order to keep the printing plate 20 from tilting relative to the plate cylinder 12. A single flat sided tapered pin 36*a* (shown in FIG. 2*a*), such as one having triangular, rectangular, or polygon-shaped cross-section would also provide the spaced apart two point contact required to reduce tilting. However, the small distance will not normally provide the preferred leverage. Thus, it is preferred that at least two tapered pins be used which are spaced apart a substantial distance and preferably multiple tapered pins are used, which are spaced apart at regular intervals, substantially entirely along the length of the plate cylinder. This will maximize the leverage and positioning power of the tapered pins when engaged in the registration holes.

Figure 2:
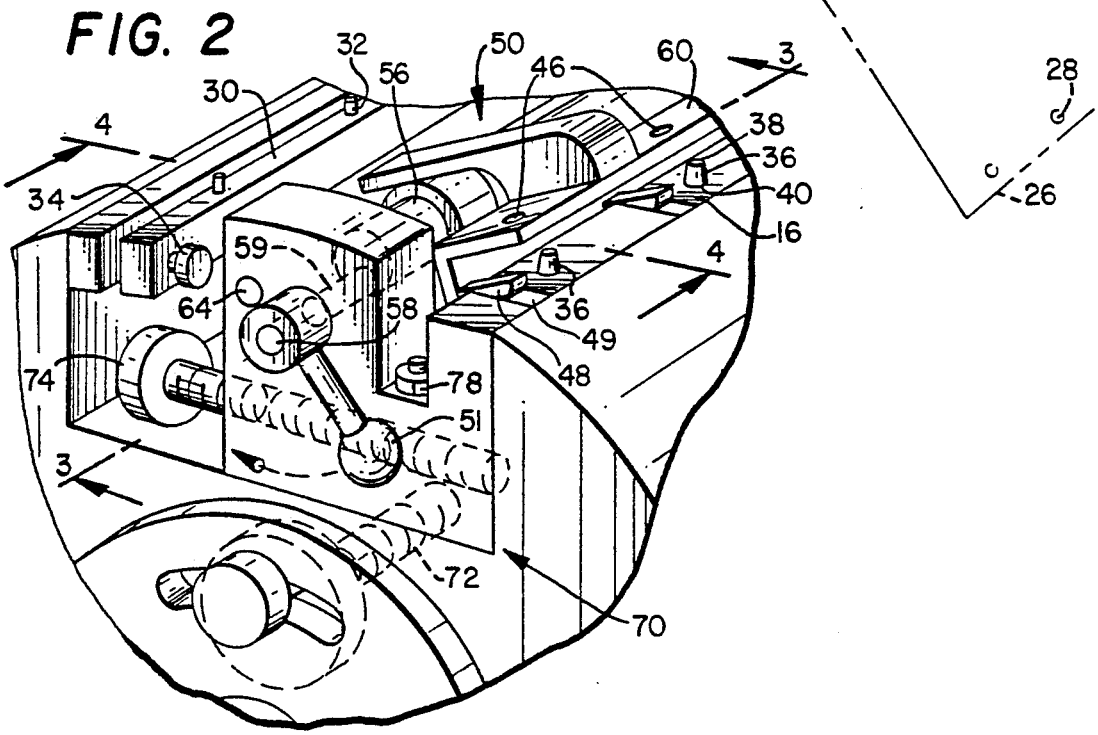
FIG. 2 is a partial enlargement of the inventive tapered pin registration device according to the present invention.
Figure 2A:
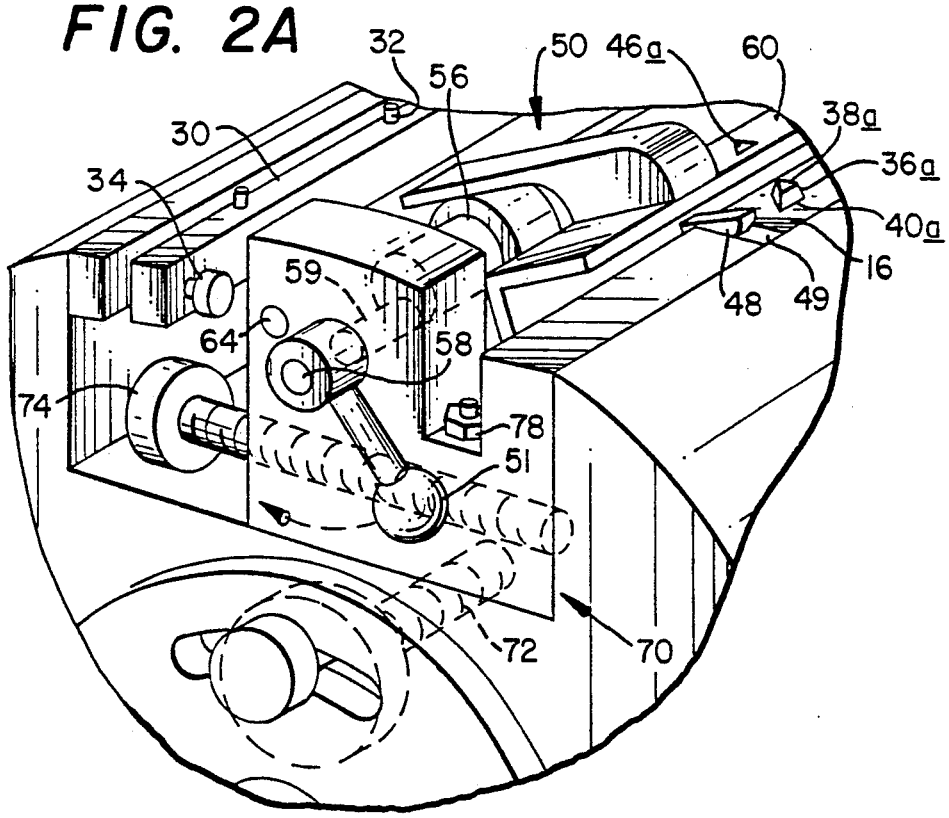
FIG. 2*a* is a partial enlargement of an alternative embodiment of a tapered pin registration device according to the present invention.

According to the present invention, the tapered pins will have a small top portion 38 (a small triangular shaped top portion 38*a* is depicted in FIG. 2*a*) and a larger base portion 40 (a triangular base portion 40*a* is depicted in FIG. 2*a*. The size of the tapered pin base portion 40 will be slightly larger than the correspondingly shaped registration holes punched or otherwise formed in the printing plate 20. A clamp 42 is activatable to clamp against the printing plate edge 22 while forcing periphery 25 of the holes 24 into rigid engagement around the entire periphery 41 of the base portion 40 of the tapered pins 36.

In the particular preferred embodiment depicted in the Figures, tapered pins 36 have a truncated conical shape, so that there is a small circular top portion 38 and a larger circular cross-sectional base portion 40. Base portion 40 is adjacent support surface 16 and projects outwardly therefrom. Clamp 42 has an elongated clamping jaw 60 with a clamping surface 44 into which holes 46 or 46*a* (shown in FIG. 2*a*) are formed corresponding in shape to the cross-sectional shape of pins 36. Clamping jaw 60 may, for example, be constructed of an elongated plate or bar supported from clamp pivot bearing 64. Cylindrical holes 46 are shown in the preferred embodiment. The clamping holes 46 are sized at the clamping surface 44 larger than the base portion 40 of tapered pins 36. This can be conveniently accomplished by drilling straight through elongated clamping jaw 60 at positions aligned with the position of each tapered pin 36. Alternatively, holes 46 could be formed at a taper to provide sufficient clearance for the tapered pin 36. The size of each clamping hole 46 is larger adjacent to surface 44 than the size of the base 40 of each of the tapered registration pins 36 to accommodate a small amount of deformation of the printing plate around the circumference 25 of holes 24 of printing plate 20 as it is forced into rigid engagement around the entire circumference 41 of the base 40.

Figure 3:
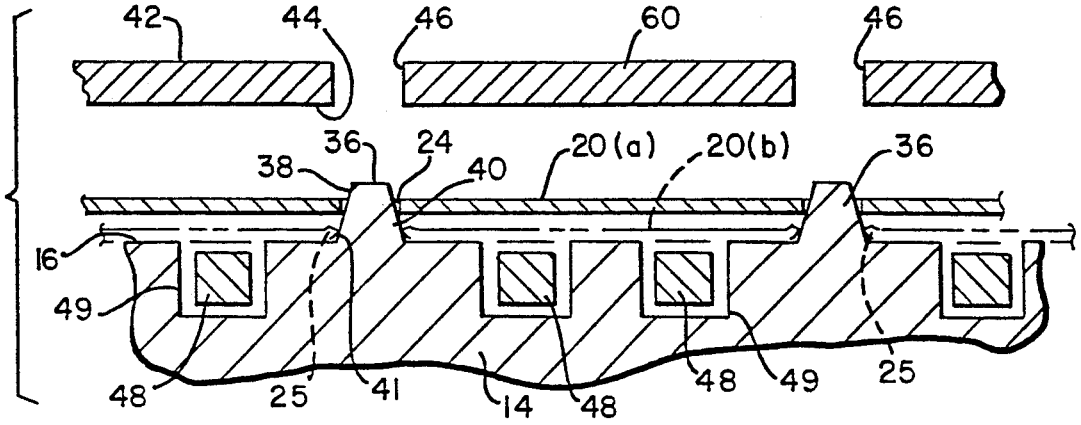
FIG. 3 is a partial cross-sectional view taken along section line 3—3 of the tapered pin registration device depicted in FIG. 2.
Figure 4:
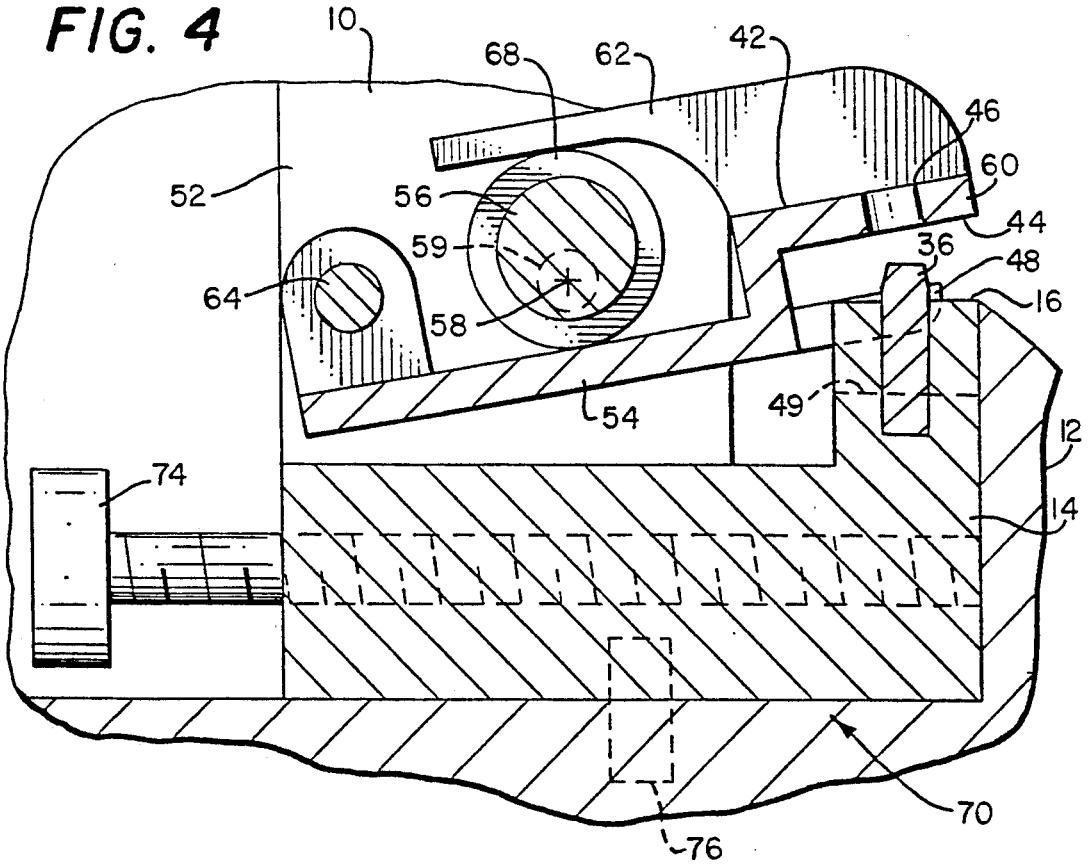
FIG. 4 is a partial cross-sectional view of the tapered pin registration device taken along section line 4—4 of FIG. 2.

As more clearly depicted in large partial perspective view of FIG. 2, as well as in cross-sectional views of FIG. 3 and FIG. 4, taken along lines 3—3 and 4—4 of FIG. 2, the construction and operation of the tapered pin registration device 10, in particular the cam-operated clamping mechanism 50 may be fully understood.

The clamping cam assembly 50 is rigidly attached to or integrally formed with support bar 14 on registration device 10. Pivot bosses 52 are provided spaced apart adjacent support bar 14 for rotationally holding cam shaft 56, which extends from one boss 52 to the next. Cam shaft 56 is pivotable at 58 about an offset axle 59 using a cam handle 51. Cam shaft 56 moves during its rotation with an eccentric motion and slides against clamping plate 54 and upward against one or more release fingers 62 which act as a cam follower. Clamping plate 54 and release fingers 62 translate their motion to clamp jaw 60 and clamping surface 44 attached thereto, so that eccentric rotation of cam shaft 56 against clamping plate 54 pushes the clamping plate and clamp jaw 60 downward, moving the clamping surface 44 against the printing plate 20 thereby holding it in rigid clamped engagement between clamping surface 44 and support surface 16. Upon rotation of the cam shaft 56 about pivot 58, it engages one or more release fingers 62 to lift clamping surface 44 off of printing plate 20.

Clamping plate 54 and attached clamp jaw 60 are pivoted about clamp pivot bearing 64 spaced apart from cam shaft 56, thereby providing the sufficient leverage to provide a desired clamping force which is sufficient to hold the printing plate 20 rigidly in place. A wear resistant bearing 68 may be interposed between cam shaft 56 and clamping plate 54 to increase the durability and ease of operation of the clamping assembly 50.

In this manner, a pre-punched printing plate 20 can be quickly placed over the small tops 38 of tapered pins 36 and upon moving handle 51, the cam shaft 56 moves against clamping plate 54 and surface 44 pushes the plate 20 downward onto the base portion 40 of the tapered pins 36. An even force is thus applied entirely around the circumference 25 of the holes 24 and correspondingly around circumference 41 of the pins 36. This uniform omni-directional force rigidly holds the plate 20 in proper alignment even against inadvertent misalignment, such as operator-applied side pressures which might otherwise move the plate into a misaligned position.

With specific reference to FIG. 3, the operation of the clamp 42 to accurately register printing plate 20 will be more fully understood. The cross-sectional view of clamp 42 is schematically depicted and the printing plate is shown in solid cross-section in a first position 20(*a*) and also in a second clamped position in phantom lines 20(*b*). Thus, when clamping surface 44 is moved with clamp jaw 60 downwardly toward support surface 16, plate 20 is moved from position 20(*a*) to position 20(*b*). Circumference 25 of each hole 24 is pressed downward onto base 40 of tapered pin 36. A slight deformation as shown in phantom lines results entirely around circumference 25 as it conforms to circumference 41 of base 40. Uniform deformation causes an omni-directional alignment force to be asserted on plate 20. The amount of alignment force is determined by a combination of the characteristics, such as strength and modulus of elasticity of the printing plate material and also the total linear inches of the combined circumferences 25 of the multiple holes 24 as they are pressed onto tapered pins 36. Preferably, a greater number of holes 24 will be used for larger printing plates. A standard diameter circular hole can be punched. Holes having diameters of between about $\frac{1}{8}$ and $\frac{3}{8}$ of an inch (between about 3 mm and 10 mm) may be used consistent with standard punching capabilities. Typically, a coated aluminum printing plate 20 will have a thickness of approximately 20 thousandths of an inch (0.020 inch or about 0.5 mm) and can be punched with known types of hardened steel punches. Larger diameter holes may be used for larger presses and printing plates. Also, different size holes 24 may be used at various locations in the same printing plate 20, provided there are correspondingly different size tapered registration pins correspondingly located for proper registration. This, for example, might be advantageous in a given situation where the printing plate 20 is smaller than cylindrical surface 18 of plate cylinder 12 and where clamping bar 14 has more pins 36 than the plate 20 has holes. The different hole sizes could thus be arranged to properly orient the printing plate 20 onto the appropriate pin locations, as toward one end of the plate cylinder or the other.

Lifting arms 48 are preferably positioned adjacent each registration pin 36 to facilitate removal of the printing plate 20 once it has been clamped into rigid engagement on the tapered pins 36. Preferably, lifting arms 48 fit within channels 49 formed in support bar 14 below support surface 16. When the clamp 42 is in closed clamping engagement, lifting arms 48 are positioned below surface 16. When the clamp 42 is in an open position, lifting arms 48 are activatable to move upwardly against plate 20 thereby applying sufficient force to dislodge the deformed portion 25 from base 40 of each pin 36. Advantageously, in the preferred embodiment, lifting arms 48 will contact printing plate 20 on each side of each tapered registration pin to avoid tipping and potentially jamming the plate as it is lifted. Preferably, lifting arms 48 are rigidly attached to or integrally formed with a clamp assembly 50 so that when clamp jaws 60 of clamp 42 are opened, lifting arms 48 are also automatically lifted.

The initial adjustment of the position of the tapered pins 36 is facilitated by initially manufacturing the device 10 with the pins 36 uniformly aligned along the support bar 14. When the registration device 10 is engaged in the plate cylinder 12, an adjustment mechanism 70 is used to initially position the aligned tapered pins parallel with the plate cylinder axis. Adjustment device 70 may, for example, comprise adjusting screws 72 for aligning the registration device 10 centrally located between the ends of plate cylinder 12. Circumferential position of registration device 10 is adjusted using circumferential adjusting screws 74. As depicted in FIG. 4, a pivot pin 76 may be interposed between the plate cylinder 12 and the registration device 10. In this arrangement, an axial adjusting screw 72 need not be used, because proper positioning in the axial direction is accomplished with pivot pin 76. One or more adjusting screws 74 can be used in conjunction with pivot pin 76 to provide the proper tilting orientation to the printing plate. Preferably, pivot pin 76 will be at one end of support bar 14 and adjusting screw 74 will be at the other end to provide accurate or fine adjustment. Once the positioning of the registration device 10 is accomplished, it is secured as with locking bolts 78, and repeatable positioning of the image can be accomplished without further adjustments. Consistent registration and clamping alignment is insured by the tapered pins 36 and clamp 42, provided each image is imprinted on the separate replaceable printing plates 20 in the same location relative to the punched leading edge registration holes 24.

Figure 5:
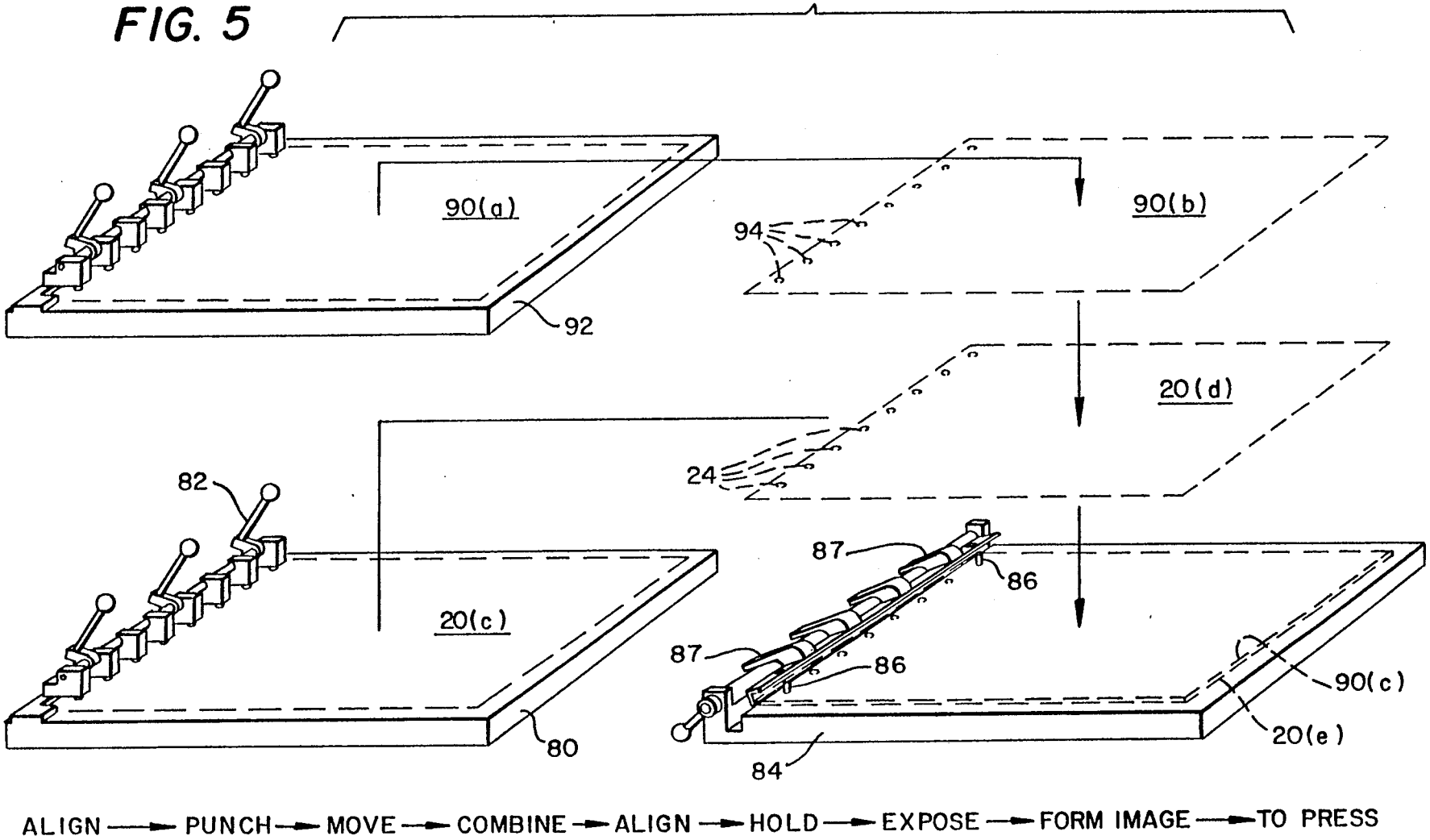
FIG. 5 is a schematic view of an image forming and registration hole punching operation on a replaceable printing plate which is useful in a registration system, which includes the tapered pin registration device of FIGS. 1-4.

With reference to FIG. 5, which is a schematic depiction of an image forming and simultaneous punching operation according to the present inventive system, those skilled in the art will understand how the image may be consistently formed at a desired location relative to the punched holes 24. Plate 20 is placed in alignment at 20(*c*) in a punching position on punch table 80. A punch 82 is operated to form holes 24. A photographic negative 90 is punched on table 92 with identically positioned holes 94 which are slightly smaller than holes 24. The plate and negative are removed as at 20(*d*) and 90(*b*) and both are moved and stacked together onto image forming table 84 where they are held at position 20(*e*) and 90(*c*) to form the desired image. Tapered pins 86 and clamp mechanism similar to the registration pins 36 and clamp mechanism 50 of device 10 may be used for purposes of alignment. The smaller holes 94 fit higher on tapered pins 86 so that both plate 20 and photographic negative 90 are pulled onto table 84 for light exposure and image formation. Thus, by forming each image in proper registration with respect to the simultaneously punched registration holes 24, the plates 20 may replaceably be inserted on a given printing press without time-consuming and tedious alignment of the printing plate 20 on the plate cylinder 12 as previously was a customary practice.

Thus, what has been disclosed is a tapered pin printing plate registration device and a registration system which accurately insures proper registration of a replaceable printing plate without readjustment of each printing plate when it is installed.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. A printing plate registration device for holding a replaceable printing plate in proper registration on a plate cylinder for use in an offset printing press, said replaceable printing plate having at least one registration hole formed in it and said printing plate registration device comprising:

(a) a support bar sized for attachment to a plate cylinder adjacent to a cylinder surface of said plate cylinder;

(b) at least one tapered registration pin affixed to said support bar, said at least one tapered registration pin having a base sized for interference fit with said at least one registration hole in said replaceable printing plate; and (c) a clamp attached to said support bar for holding said at least one registration hole in said replaceable printing plate into rigid interference fit entirely around said base of said at least one tapered registration pin.

2. A printing plate registration device as in claim 1 further comprising:

(a) said at least one tapered registration pin attached projecting vertically from said support bar;

(b) a channel formed in said support bar adjacent said at least one tapered registration pin;

(c) a lifting arm attached to said registration device movable between a first position at which said lifting arm is interposed in said channel and a second position at which said lifting arm is above said support bar; and (d) means for activating said lifting arm from said first to said second position to push said replaceable printing plate off of said at least one tapered pin.

3. A printing plate registration device as in claim 1 wherein:

(a) said support bar further comprises a support surface adjacently aligned with said cylindrical surface of said plate cylinder; and (b) said clamp further comprises a clamping hole defined by a clamping surface therearound, which clamping hole and clamping surface are activatable to rigidly clamp said printing plate against said support surface as said printing plate is also held in rigid interference fit around said base of said tapered registration pin.

4. A printing plate registration device as in claim 3 further comprising:

(a) said at least one tapered registration pin attached projecting vertically from said support surface;

(b) a channel formed in said support surface adjacent sad at least one tapered registration pin;

(c) a lifting arm attached to said registration device movable between a first position at which said lifting arm is interposed in said channel below said support surface and a second position at which said lifting arm is above said support surface; and (d) means for activating said lifting arm from said first to said second position to push said replaceable printing plate off of said at least one tapered pin.

5. A printing plate registration device for replaceably holding a replaceable printing plate in proper registration on a plate cylinder for use in an offset printing press, said replaceable printing plate having a plurality of registration holes formed in it and said printing plate registration device comprising:

(a) a support bar sized for attachment to a plate cylinder so that a support surface on said support bar is adjacently aligned with a cylindrical surface of said plate cylinder;

(b) a plurality of tapered registration pins affixed to said support bar and correspondingly located for engagement with corresponding ones of said plurality of registration holes and said tapered registration pins having bases sized for interference fit with said registration holes in said replaceable printing plate; and (c) a clamp attached to said support bar for holding said registration holes in said replaceable printing plate into rigid interference fit entirely around said bases of each of said tapered registration pins.

6. A printing plate registration device as in claim 5 further comprising:

(a) said plurality of tapered registration pins projecting vertically from said support surface;

(b) a channel formed in said support surface adjacent said plurality of tapered registration pins;

(c) a lifting arm attached to said registration device movable between a first position interposed in said channel below said support surface and a second position above said support surface; and (d) means for activating said lifting arm from said first to said second position to push said replaceable printing plate off of said plurality of tapered registration pins.

7. A printing plate registration device as in claim 5 wherein said registration holes are circular holes and said plurality of tapered registration pins are in the shape of truncated cones having a smaller top portion spaced above said support surface and a larger base portion immediately adjacent said support surface.

8. A printing plate registration device as in claim 5 wherein said clamp further comprises:

(a) an eccentric cam shaft rotatably attached to said support bar and rotatable between a clamped position and a released position;

(b) a clamping plate pivotably attached to said support bar at a point spaced apart from said rotatably attached eccentric cam shaft and positioned for contact with said eccentric cam shaft as it is rotated; and (c) a clamping surface rigidly attached to said clamping plate and positioned therewith for corresponding clamping engagement with said support surface of said support bar, said clamping surface defining holes therein which holes are correspondingly positioned and aligned with said tapered pins and which holes are sized larger than said tapered pins for fitting thereover when said eccentric cam shaft is moved into a clamping position.

9. A printing plate registration device as in claim 5 wherein:

(a) said support bar is sized to extend entirely across the length of said plate cylinder and in parallel alignment with said plate cylinder; and (b) said plurality of tapered registration pins are affixed at spaced apart locations along said support bar, which locations lie along an imaginary line which is parallel to said plate cylinder.

10. A system for printing plate registration comprising:

(a) a printing plate punching mechanism for punching registration holes along a leading edge of said printing plate;

(b) an image forming mechanism having registration pins and a clamping mechanism corresponding in size and location to said punched registration holes for holding said printing plate in precise registration alignment when an image is photo-chemically formed thereon; and (c) a printing plate registration device including a support bar sized for attachment to a plate cylinder adjacent to a cylindrical surface of said plate cylinder, a plurality of tapered registration pins affixed to said support bar, each of said plurality of tapered registration pins having a base sized for interference fit with said punched registration holes in said replaceable printing plate, and a clamp attached to said support bar for holding said punched registration holes into rigid interference fit entirely around said base of each of said tapered registration pins, so that said image previously formed using said same punched registration holes will be held registration with another image formed on another printing plate using said system.

11. A method of printing plate registration for replaceably holding a replaceable printing plate in proper registration on a plate cylinder for use in offset printing, said method comprising the steps of:

(a) forming registration holes at precise predetermined locations along one edge of a printing plate;

(b) forming an image on said printing plate in alignment using said formed registration holes;

(c) attaching tapered registration pins to a plate cylinder corresponding in precise location to said registration holes in said printing plate;

(d) clamping said printing plate onto said tapered registration pins so that a base portion of said registration pins is engaged entirely around the circumference of said punched registration holes; and (e) securing said printing plate around the cylindrical surface of said plate cylinder with uniform tension sufficient to hold said printing plate against said plate cylinder during offset printing therewith.

12. A printing plate registration device for holding a replaceable printing plate in proper registration on a plate cylinder for use in an offset printing press, said replaceable printing plate having at least two registration holes formed in it and said printing plate registration device comprising:

(a) a support bar sized for attachment to a plate cylinder adjacent to a cylindrical surface of said plate cylinder;

(b) at least two tapered registration pins affixed to said support bar, said at least two tapered registration pins having bases sized for interference fit with said at least two registration holes in said replaceable printing plate; and (c) a clamp attached to said support bar for holding said at least two registration holes in said replaceable printing plate into rigid interference fit entirely around said bases of said at least two tapered registration pins.

13. A printing plate registration device as in claim 12 further comprising:

(a) said at least two tapered registration pins attached projecting vertically from said support bar;

(b) a channel formed in said support bar adjacent said at least two tapered registration pins;

(c) a lifting arm attached to said registration device movable between a first position at which said lifting arm is interposed in said channel and a second position at which said lifting arm is above said support bar; and (d) means for activating said lifting arm from said first to said second position to push said replaceable printing plate off of said at least two tapered pins.

14. A printing plate registration device as in claim 12 wherein:

(a) said support bar further comprises a support surface adjacently aligned with said cylindrical surface of said plate cylinder; and (b) said clamp further comprises clamping holes defined by clamping surfaces therearound, which clamping holes and clamping surfaces are activatable to rigidly clamp said printing plate against said support surface as said printing plate is also held in rigid interference fit around said bases of said tapered registration pins.

15. A printing plate registration device as in claim 14 further comprising:

(a) said at least two tapered registration pins attached projecting vertically from said support surface;

(b) a channel formed in said support surface adjacent said at least two tapered registration pins;

(c) a lifting arm attached to said registration device movable between a first position at which said lifting arm is interposed in said channel below said support surface and a second position at which said lifting arm is above said support surface; and (d) means for activating said lifting arm from said first to said second position to push said replaceable printing plate off of said at least two tapered pins.

* * * * *

UNITED STATES PATENT AND TRADEMARK OFFICE

CERTIFICATE OF CORRECTION

PATENT NO. : 5,322,014

DATED : June 21, 1994

INVENTOR(S) : James J. Keller

It is certified that error appears in the above-identified patent and that said Letters Patent is hereby corrected as shown below:

Column 3, line 51, before the word "polygon-shaped", insert ---another---.

Claim 4 at Column 7, line 60, delete "sad" and replace with ---said---; and

Claim 10 at Column 9, line 26, after the word "held", insert ---thereby in---.

Signed and Sealed this

Eleventh Day of October, 1994

*Attest:*

Bruce Lehman

BRUCE LEHMAN

*Attesting Officer*

*Commissioner of Patents and Trademarks*